US007263856B2

(12) United States Patent
Choi et al.

(10) Patent No.: US 7,263,856 B2
(45) Date of Patent: Sep. 4, 2007

(54) REFRIGERATOR

(75) Inventors: Bong Jun Choi, Changwon-si (KR); Sang Ik Lee, Cheongju-si (KR); Jae Seong Sim, Busan (KR); Young Jeong, Gwangmyeong-si (KR)

(73) Assignee: LG Electronics Inc., Seoul (KR)

( * ) Notice: Subject to any disclaimer, the term of this patent is extended or adjusted under 35 U.S.C. 154(b) by 142 days.

(21) Appl. No.: 11/137,800

(22) Filed: May 26, 2005

(65) Prior Publication Data

US 2006/0266069 A1 Nov. 30, 2006

(51) Int. Cl.
*F25D 17/04* (2006.01)
*F25D 17/06* (2006.01)

(52) U.S. Cl. ..... 62/408; 62/411

(58) Field of Classification Search ..... 62/161, 62/186, 187, 407, 408, 454, 414–417, 419, 62/426, 455, 411

See application file for complete search history.

(56) References Cited

U.S. PATENT DOCUMENTS

| | | | | |
|---|---|---|---|---|
| 1,727,713 | A * | 9/1929 | Juneau et al. | 62/408 |
| 2,169,914 | A * | 8/1939 | Hoch | 62/313 |
| 3,834,177 | A * | 9/1974 | Scarlett | 62/288 |
| 4,722,200 | A * | 2/1988 | Frohbieter | 62/382 |
| 4,903,501 | A * | 2/1990 | Harl | 62/187 |
| 5,187,941 | A * | 2/1993 | Tershak et al. | 62/89 |
| 5,720,185 | A * | 2/1998 | Lee | 62/408 |
| 5,822,998 | A * | 10/1998 | Lim et al. | 62/186 |
| 6,564,566 | B2 * | 5/2003 | Kim et al. | 62/225 |
| 6,675,588 | B2 * | 1/2004 | Rudick | 62/6 |
| 6,735,976 | B2 * | 5/2004 | Lee | 62/419 |
| 6,840,057 | B2 * | 1/2005 | Yun et al. | 62/407 |
| 6,931,863 | B2 * | 8/2005 | Chen et al. | 62/6 |

FOREIGN PATENT DOCUMENTS

| | | |
|---|---|---|
| DE | 10356963 | 7/2004 |
| JP | 08005225 | 1/1996 |
| JP | 2004-332779 | 12/2004 |
| KR | 1020030021876 | 3/2003 |
| WO | WO 00/75584 A1 * | 12/2000 |
| WO | WO 03/085338 | 10/2003 |

* cited by examiner

*Primary Examiner*—Mohammad M. Ali
(74) *Attorney, Agent, or Firm*—Ked & Associates, LLP

(57) ABSTRACT

A refrigerator is disclosed, by which a specific part of a freezer room and/or a specific part of a cold storage room can be adjusted. The refrigerator includes a body having a cold storage room and a freezer room, an evaporator provided to the body to generate cold air, a plurality of racks partitioning each of the cold storage and freezer rooms into a plurality of chambers, and at least one adjustment device provided to each rear portion of the racks, the at least one adjustment device configured to adjust a quantity of the cold air supplied to each of the chambers.

29 Claims, 8 Drawing Sheets

REFRIGERATOR

The present invention relates to a refrigerator, and more particularly, to a structure for supplying cool air within a refrigerator.

DISCUSSION OF THE RELATED ART

Generally, a refrigerator is a device for storing food freshly for a predetermined time by cooling down its inner space while a refrigerant (operational fluid) repeats a cooling cycle of compression-condensation-expansion-evaporation. Such a refrigerator basically consists of a compressor transforming a low temperature/low pressure gas refrigerant into a high temperature/high pressure gas refrigerant, a condenser condensing the refrigerant introduced from the compressor, an expansion valve lowering a pressure of the refrigerant supplied from the condenser, and an evaporator absorbing heat from a neighbor atmosphere by evaporating the refrigerant at a low pressure.

A configuration and operation of a general side-by-side type refrigerator are explained with reference to the attached drawings as follows.

Referring to FIG. 1, a refrigerator is mainly divided into a freezer room 1 into which most of cold air generated from an evaporator 4 is introduced and a cold storage room 2 into which a portion of the cold air generated from the evaporator 4 is introduced. The freezer room 1 and the cold storage room 2 are partitioned from each other by a partition 3. A first opening 3*a* is provided to an upper rear part of the partition 3 to supply cold air generated from the evaporator 4 through heat exchange to the cold storage room 2. And, a second opening 3*b* is provided to a lower rear part of the partition 3 to supply the cold air having circulated through the cold storage room 2 to the freezer room 1 again.

Referring to FIG. 2, a blower fan 6 forcibly circulating the air cooled down via the evaporator 4 to the cold storage room 1 and a motor driving the blower fan 6 are provided over the evaporator 4. A barrier 7 is provided in front of the evaporator 4 to separate the freezer room 1 and a space for an installation of the evaporator 4 from each other. And, an outlet duct 1*o* is provided within the barrier 7. A multitude of outlets 11 communicating with the freezer room 1 are formed at the barrier 7. An inlet 13 is provided to a lower part of the barrier 7 to re-supply the cold air having passed through the cold storage and freezer rooms to the evaporator 4. And, a mechanic room 5 is provided under the freezer room 1 to receive a compressor, a condenser and the like except the evaporator 4.

Once power is supplied to the above-configured refrigerator, a series of process for refrigerating food is initiated by a refrigeration system including the evaporator, the compressor, the condenser and the like. Air passes through the evaporator 4 to be cooled down by heat exchange and is then blown into the outlet duct 10 by the blower fan 6. Subsequently, a portion of the cold air is supplied to the freezer room 1 via the outlets 11 and the rest is introduced into the cold storage room 2 via the first opening 3*a*. Thereafter, the cold air having circulated through the freezer room 1 and the cold storage room 2 is introduced into the evaporator via the inlet 13 to be cooled down.

However, since the cold air is supplied to the freezer room 1 via the duct 10, the flow path of the cold air is too long and complicated in the related art refrigerator. And, the duct 10 of the related art refrigerator fails in being provided with a function of adjusting a quantity of cold air supplied to each portion of the freezer room 1 appropriately. Moreover, the complicated path raises flow resistance to increase loads of the blower fan 6 and the motor driving the blower fan 6.

Besides, in the related art refrigerator, the space occupied by the duct 10 substantially reduces the inner space of the freezer room 1.

SUMMARY OF THE INVENTION

Accordingly, the present invention is directed to a refrigerator that substantially obviates one or more problems due to limitations and disadvantages of the related art.

An object of the present invention is to provide a refrigerator, in which a simple passage enabling appropriate adjustment of a cold air supply quantity is provided.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a refrigerator according to the present invention includes a body having a cold storage room and a freezer room, an evaporator provided to the body to generate cold air, a plurality of racks partitioning each of the cold storage and freezer rooms into a plurality of chambers, and at least one adjustment unit provided to each rear portion of the racks, the at least one adjustment unit configured to adjust a quantity of the cold air supplied to each of the chambers.

The cold storage room and the freezer room are arranged side by side. The evaporator is configured to flow the cold air upwardly along a rear wall of the cold storage or freezer room. Preferably, the evaporator includes a plurality of columns arranged in a front-to-rear direction.

Preferably, the refrigerator further includes a cover enclosing the evaporator. The cover includes an outlet for blowing the cold cir upwardly. The cover further includes an auxiliary outlet configured to directly blow the cold air to the chamber in the vicinity of the evaporator.

Each of a plurality of the racks leaves a predetermined gap from a rear wall of the freezer or cold storage room. And, the refrigerator further includes a cold air passage provided between a rear wall of the freezer or cold storage room and the rear portions of the racks to allow the cold air to flow therein wherein the cold air will supplied to the chambers.

A plurality of the adjustment units are provided to the rear portions of a plurality of the racks, respectively. Namely, the at least one adjustment unit is configured to adjust a cross-sectional area of a passage for flowing the cold air therein. Preferably, gaps between the adjustment units and rear walls of the freezer or cold storage room are gradually narrowed along a flow direction of the cold air. Specifically, the at least one adjustment unit includes a separator movably provided to a rear end of the rack. The separator includes a plate member. The separator is rotatably provided to the rear end of the rack. And, the separator is turned upwardly and downwardly. Alternatively, the separator is provided to the rear end of the rack to move backward and forward.

Preferably, the adjustment unit further includes a drive mechanism selectively driving the separator according to a cold air quantity required for the corresponding chamber. The drive mechanism includes a slider provided to the rack to move forward and backward and a link bar hinged between the slider and the separator. The slider is projected from a front end portion of the rack to be operated by a user. The drive mechanism further includes a groove extending parallel to a lateral side of the rack to receive the slider therein.

Preferably, minimal gaps between the separators and a rear wall of the freezer or cold storage room are gradually decreased along a flow direction of the cold air. In other words, lengths of the separators gradually increase along a flow direction of the cold air.

The refrigerator further includes a barrier provided to leave a predetermined interval from a rear wall of the freezer or cold storage room. And, the barrier is configured to flow the cold air to a plurality of the chambers. The barrier is configured to conceal the at least one adjustment unit. The barrier upwardly may extend from a rear end of each of a plurality of the racks. And, the barrier is configured to cover to conceal the evaporator.

Therefore, in the above-configured refrigerator, a temperature of a specific chamber can be adjusted and the inner space is substantially expanded.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
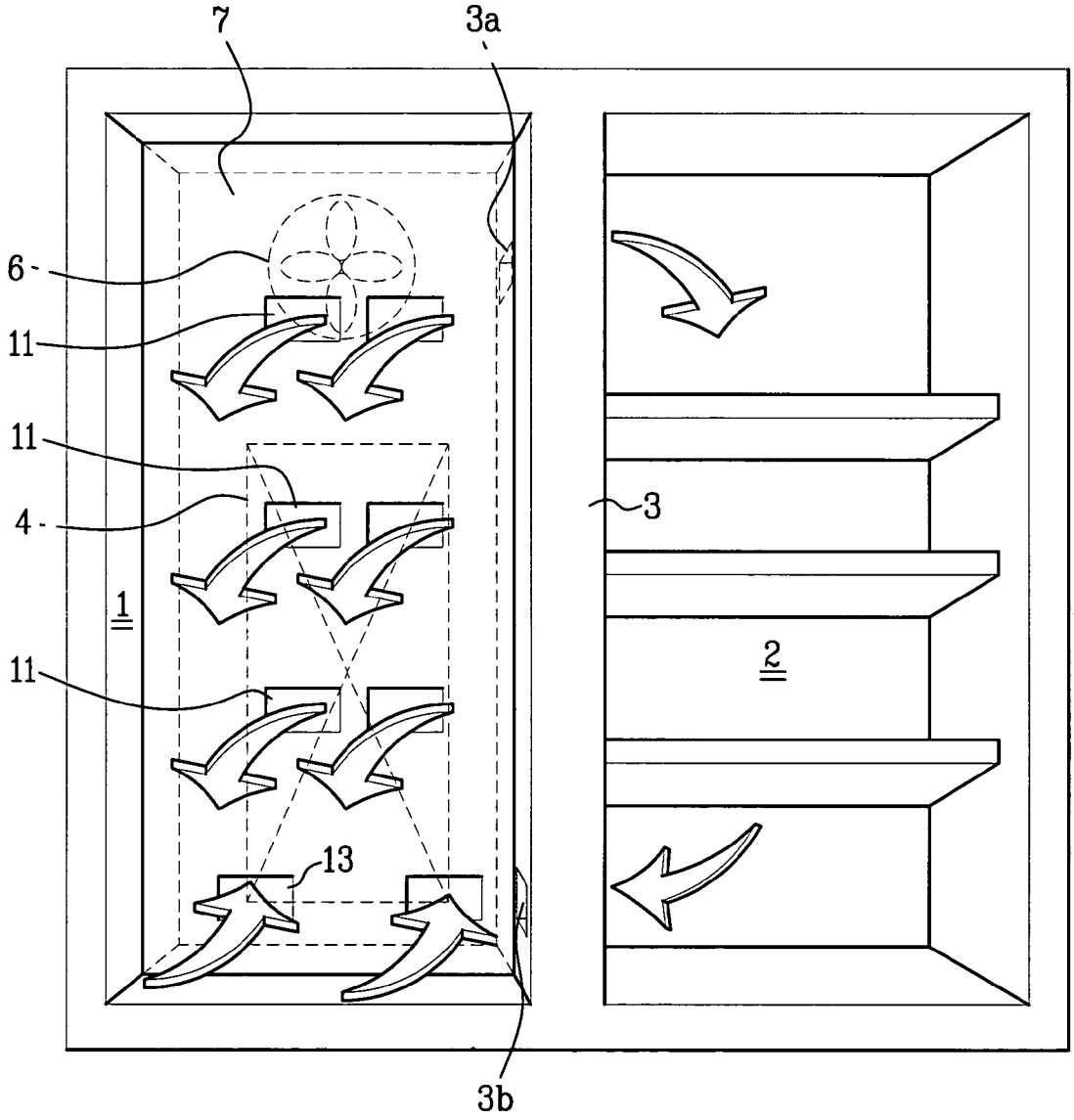
FIG. 1 is a front diagram of a refrigerator according to a related art, in which a cold air passage structure is schematically shown.
Figure 2:
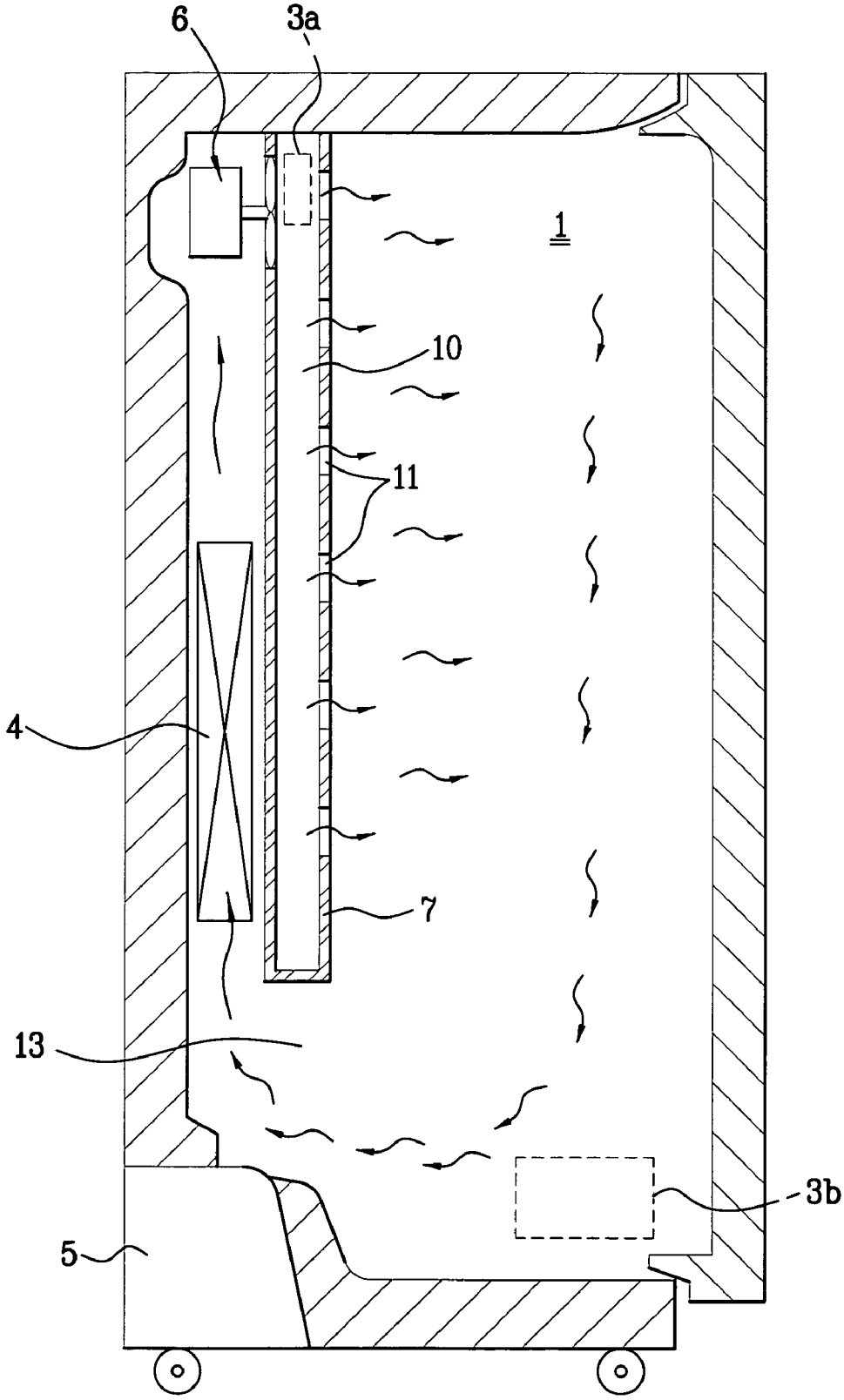
FIG. 2 is a cross-sectional diagram of the refrigerator in FIG. 1, in which a passage structure is schematically shown.
Figure 3:
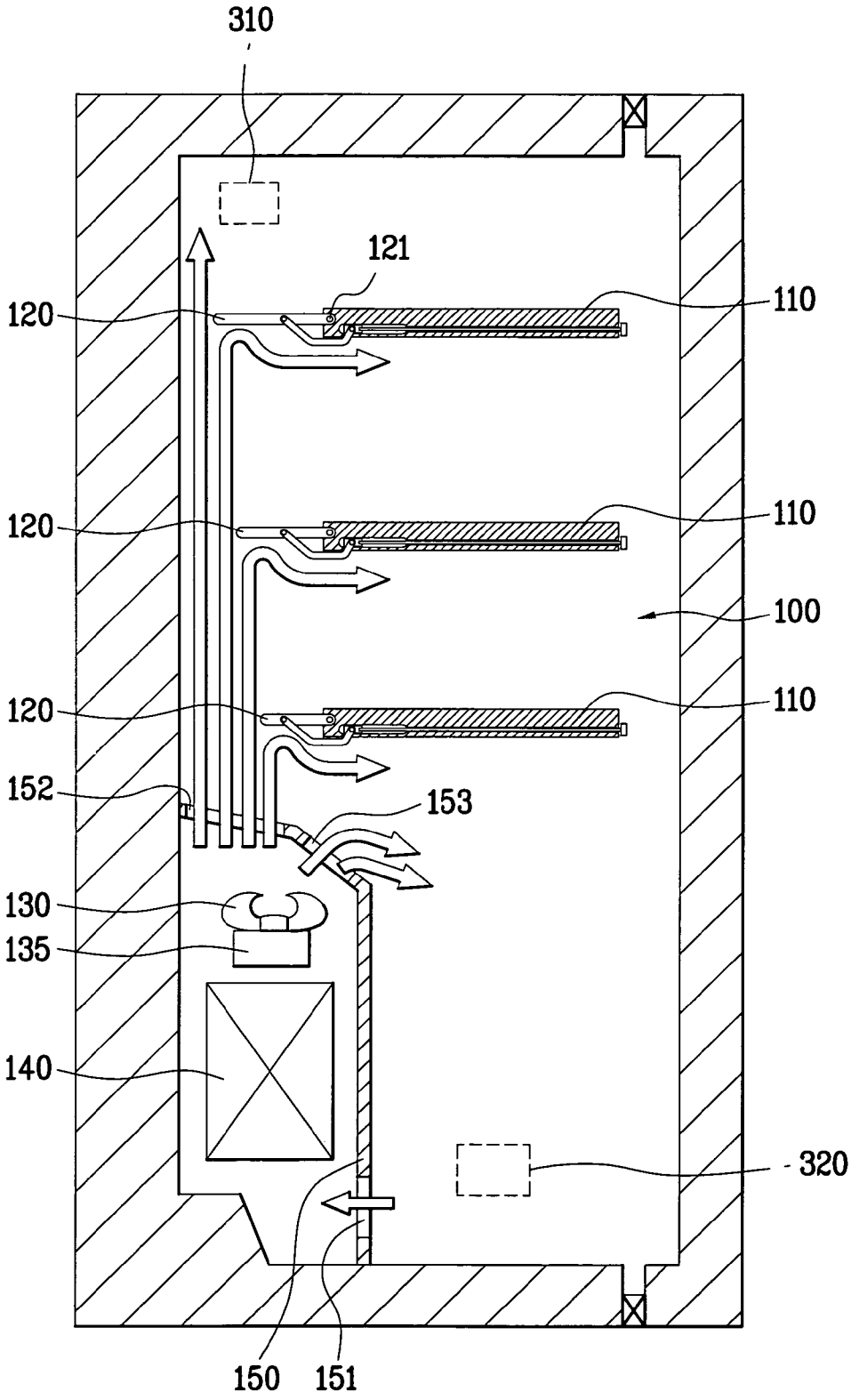
FIG. 3 is a cross-sectional diagram of a refrigerator according to the present invention.
Figure 4:
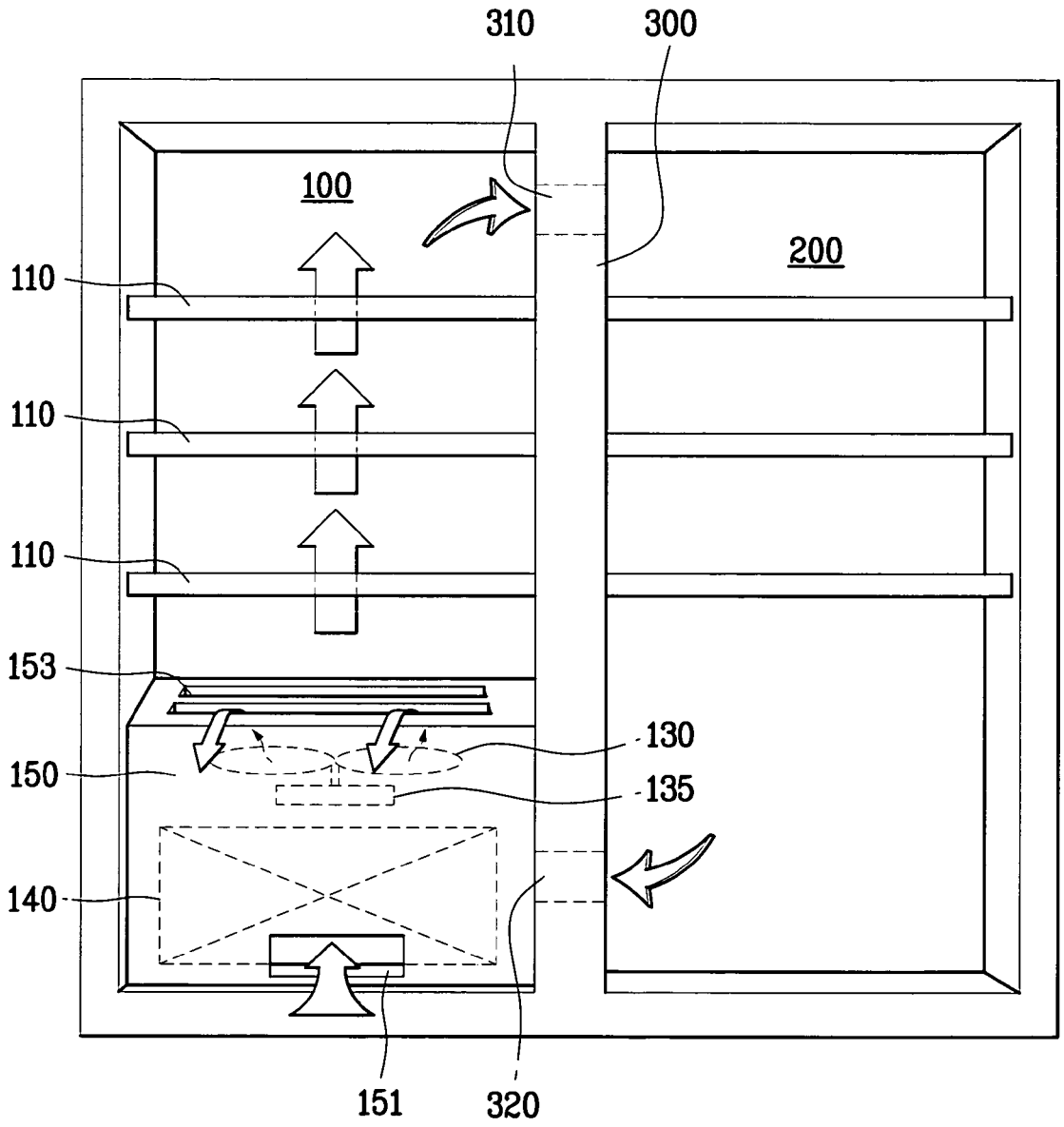
FIG. 4 is a schematic front diagram of the refrigerator in FIG. 3.

FIG. 3 is a cross-sectional diagram of a refrigerator according to the present invention and FIG. 4 is a schematic front diagram of the refrigerator in FIG. 3.

Referring to FIG. 3 and FIG. 4, a refrigerator according to the present invention includes a freezer room 100 maintaining a temperature of about −18° C. by receiving most of air cooled down by an evaporator 140 and a cold storage room 200 maintaining a temperature of 0~7° C. by receiving a portion of the air cooled down by the evaporator 140. The freezer room 100 and the cold storage room 200 are partitioned by a partition 300. A first opening 310 is provided to an upper part of the partition 300 to allow cold air to flow from the freezer room 100 to the cold storage room 200. And, a second opening 320 is provided to a lower part of the partition 300 to allow cold air to flow to the freezer room 100 from the cold storage room 200.

The evaporator 140 is provided to a lower rear part of the freezer room 100. The evaporator 140 includes at least two columns arranged in a front-to-rear direction to have a small height. Hence, the evaporator 140 substantially occupies a less space. A fan 130 upwardly blowing cold air and a motor 135 for driving the fan 130 are provided above the evaporator 140. The evaporator 140 and the fan 130 are isolated from an inner space of the freezer room 100 by a cover 150 enclosing them. An inlet 151 is formed at a lower part of the cover 150 to introduce air of the freezer room 100 toward the evaporator 140. And, an outlet 152 is formed at an upper end of the cover 150 to blow the cold air upwardly along a rear wall of the freezer room 100. And, an auxiliary outlet 153 is provided to a front part of the cover 150 to guide a portion of the cold air to a chamber in the vicinity of the evaporator 140, i.e., a lowest chamber of the freezer room.

A plurality of racks 110 are provided within each of the freezer and cold storage rooms 100 and 200 to divide each of the freezer and cold storage rooms 100 and 200 into a plurality of chambers in a vertical direction. Each of the racks 110 leaves a predetermined gap from each rear wall of the freezer and cold storage rooms 100 and 200. And, the gap between the rack 110 and the rear wall substantially plays a role as a passage for flowing the cold air.

An adjustment unit is provided to each rear part of the racks 110 to adjust a quantity of the cold air supplied to the corresponding chamber. The adjustment unit includes a plate type separator 120 provided to each rear end portion of the racks 110 to control a flow of the cold air blown along the rear wall of the freezer room. Each of the separators 120 is upwardly and downwardly turned centering on a hinge shaft 121 at the rear end portion of the corresponding rack 110. Hence, the adjustment unit can adjust the gap between the rear wall of the freezer room 100 and the rack 110 by the separator 120. Namely, the adjustment unit adjusts a cross-sectional area of the passage formed by the gaps. Therefore, the adjustment unit can adjust a quantity of the cold air supplied to the chambers by adjusting the gap or the cross-sectional area of the passage.

Figure 5A:
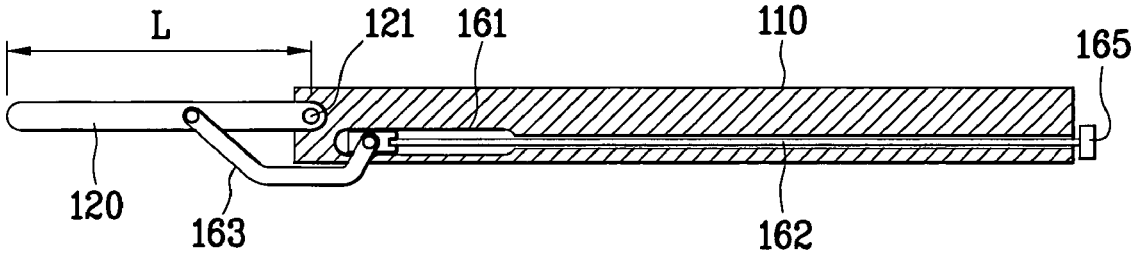
FIG. 5A and FIG. 5B are cross-sectional diagrams for explaining a structure and operation of an adjustment unit.
Figure 5B:
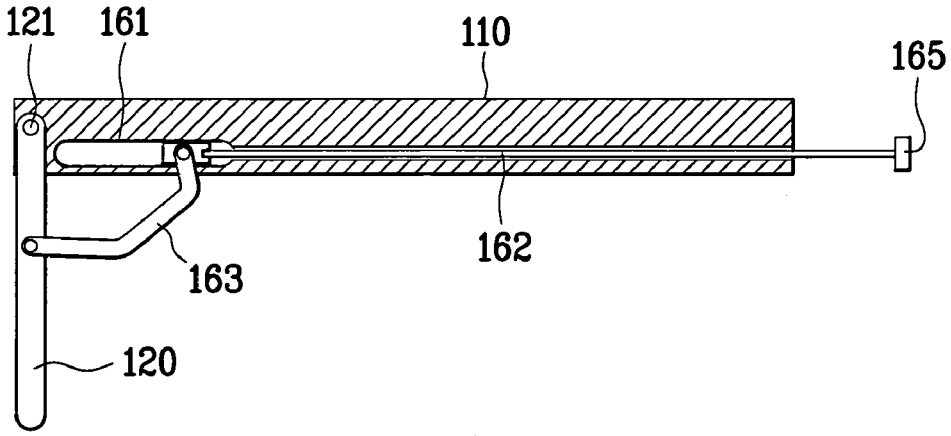

Referring to FIG. 5A and FIG. 5B, a drive mechanism is provided to each of the racks 110 to actuate the corresponding separator 120. The drive mechanism selectively actuates the separators 120 according to a cold air quantity required for each of the chambers. Specifically, the drive mechanism includes a slider 162 provided to the rack 110 to move forward and backward and a link bar 163 hinged between the slider 162 and the separator 120. The slider 162 is projected from a front portion of the rack 110 to be manually operated by a user. And, a knob 165 is provided as a handle to the projected portion of the slider 162. Moreover, a groove 161 is formed parallel on a lateral side of the rack 110 so that the slider 162 can move in the groove 161.

Once the knob 165, as shown in FIG. 5B, is pulled, the slider 162 moves forward along the groove 161 so that the separator 120 connected to the link bar 163 is turned downward. A rotational angle of the separator 120 is proportional to an extent of pulling the knob 165. In case of returning the separator 120 to the state shown in FIG. 5A, a user pushes the knob 165 backward to move the slider 162 backward so that the link bar 163 turns the separator 120 upward to maintain a horizontal state of the separator 120.

Meanwhile, lengths L of the separators 120, as shown in FIG. 3, are gradually increased along a flowing direction of cold air (upward direction) to be supplied to the chambers. Namely, a minimal gap between each of the separators 120 and the rear wall of the freezer room 100 gradually decrease along the flowing direction of the cold air. By such an arrangement, the cold air can flow to a rear part of the last chamber situated in the flowing direction (i.e., top chamber) with minimal flow resistance.

The above-configured refrigerator is operated in a following manner.

First of all, once power is supplied to the refrigerator, a series of process for refrigerating food is initiated by the refrigerating system including the evaporator, the compressor, the condenser and the like. If the fan 130 is driven by the motor 135, air of the freezer room 100 is supplied to the evaporator 140 via the inlet 151 at the lower part of the cover 150 to turn into cold air. The cold air is then blown upward along the rear wall of the freezer room via the outlet 152. In doing so, a portion of the cold air is directly blown to the bottom chamber of the freezer room via the auxiliary outlet 153.

The blown cold air sequentially passes through the gap between the rear wall of the freezer room 100 and the separator 120 provided to each of the racks 110 to be supplied to the corresponding chamber. In case that the entire separators 120, as shown in FIG. 3, are in the horizontal state, the quantity of the cold air supplied to each of the chambers is maintained uniform. If a temperature of a specific one of the chambers is needed to drop more, a user turns downward the separator 120 provided to the rack 110 situated at a lower part of the specific chamber. By such an operation, more cold air can be supplied to the specific chamber to lower the temperature therein.

Figure 6:
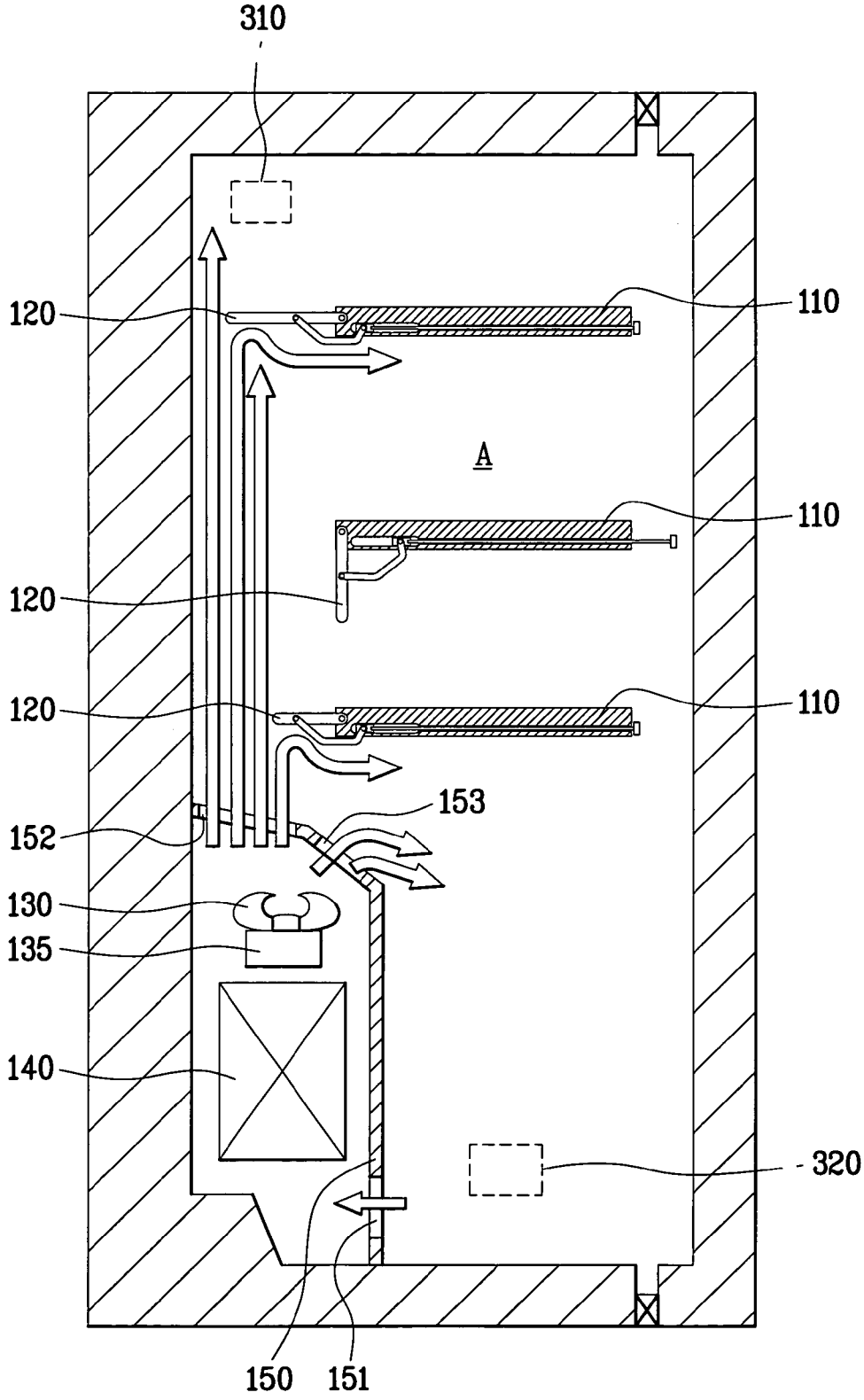
FIG. 6 is a cross-sectional diagram for explaining an operation of a refrigerator according to the present invention.

For instance, as shown in FIG. 6, in case of supplying more cold air to the chamber A, the knob 165 of the rack 110 situated at the lower part of the chamber A is pulled to turn the separator 120 downward. Hence, the gap between the rear wall of the freezer room and the separator 120 of the corresponding rack 110 is widened so that more cold air can be supplied to the chamber A. By adjusting the quantity of the cold air supplied to a specific one of the chambers in the above-explained manner, specific food can be stored at a specific temperature to maintain optimal freshness.

Since the evaporator 140 includes a plurality of columns situated in the lower part of the freezer room, a space above the evaporator can be used as a part of the freezer room. And, a separate cold air duct is not needed due to the use of the adjustment unit (i.e., separators), whereby a size or volume of the freezer room is substantially raised.

Meanwhile, the cold air having moved to a most upper part of the freezer room 100 is introduced into the cold storage room 200 via the first opening 310 formed at the upper part of the partition 300 to cool down an inner space of the cold storage room 200. Thereafter, the cold air is introduced into the freezer room 100 via the second opening 320 to repeat such a circulation.

In the above-explained embodiment of the present invention, each of the separators 120 of the racks 110 is independently operated. Yet, the separators 120 can be mutually connected via a link mechanism to operate simultaneously. In the above-explained embodiment of the present invention, each of the separators 120 adjusts the gap between the rear wall and the rack by the rotational movement. Alternatively, each of the separators 120 can be configured to adjust the gap by a straight movement. Optionally, each of the separators 120 can be configured to be automatically or semi-automatically operated using a gear, a motor, etc. appropriately.

Figure 7:
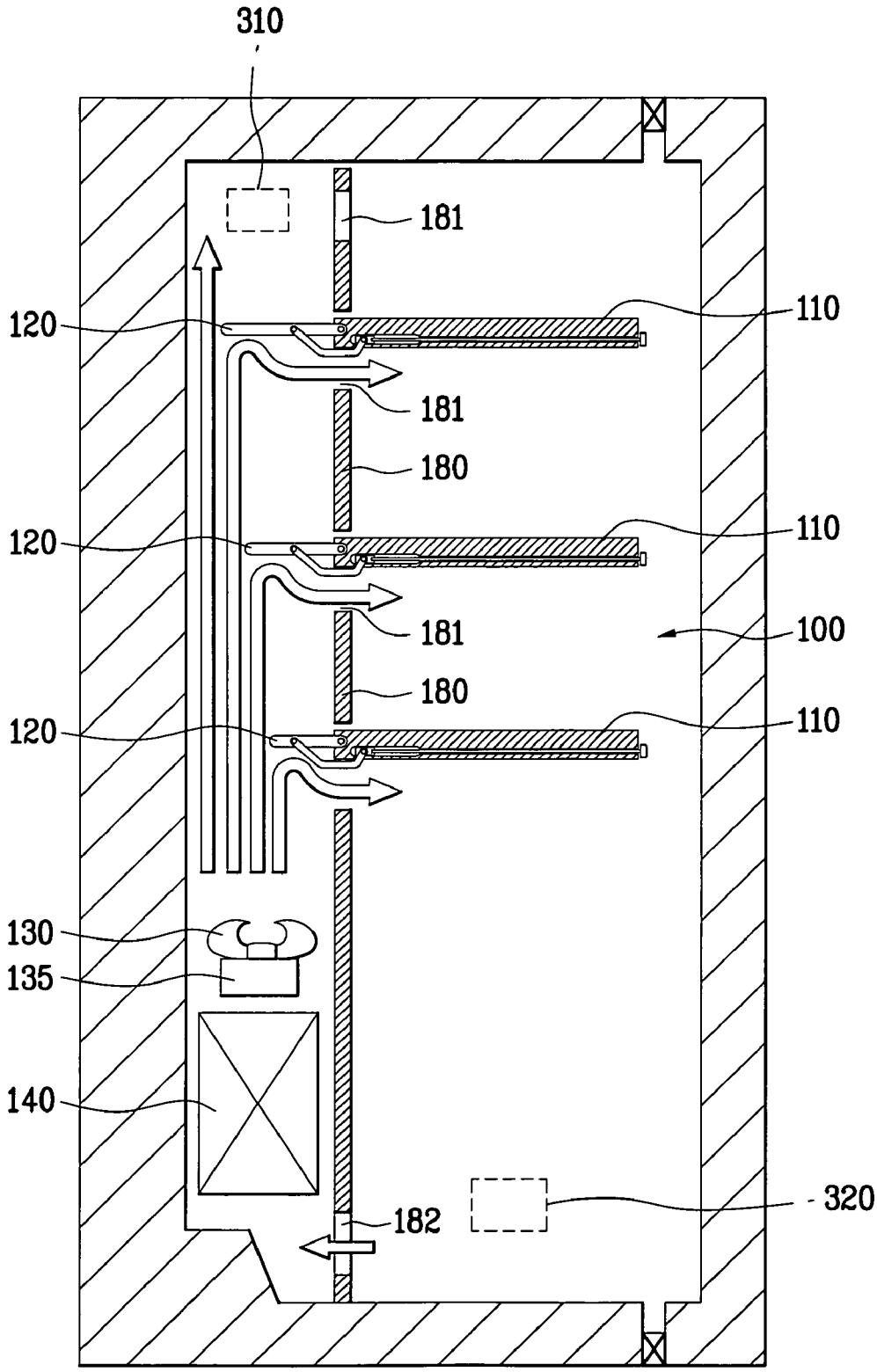
FIG. 7 is a cross-sectional diagram of a refrigerator according to another embodiment of the present invention.
Figure 8:
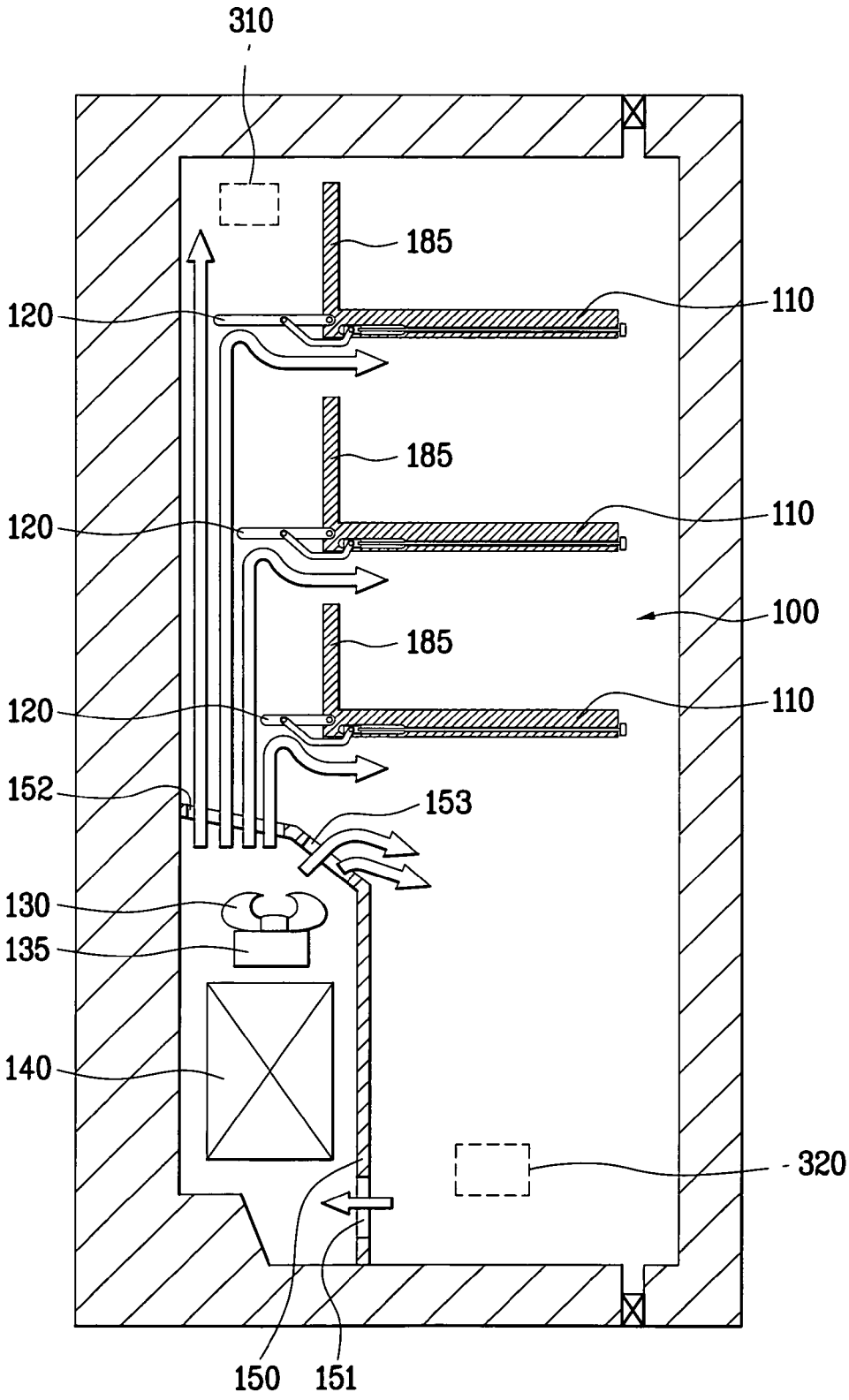
FIG. 8 is a cross-sectional diagram of a modification of the refrigerator in FIG. 7.

Meanwhile, a barrier 180, as shown in another embodiment of the present invention of FIG. 7, can be provided to leave a predetermined distance from a rear wall of a freezer room 100. In the former embodiment of the present invention, the cold air passage (i.e., the space between the racks and the rear wall) has an open structure. Yet, the barrier 180 substantially configures an independent passage along the rear wall to conceal the separators 120. In this case, the barrier 180 can be provided in front of the evaporator 140 to conceal an evaporator 140 without the cover 150 of the former embodiment of the present invention. The barrier 180 includes an outlet 181 communicating with each chamber and an inlet 182 communicating with a part under the evaporator 140. Moreover, the barrier 180, as shown in FIG. 8, can be vertically extended from each rear end portion of a plurality of racks 110 to have a predetermined height.

In the above description, the present invention is applied to the freezer room 100. Likewise, the present invention is applicable to the cold storage room 200 in the same manner as well. Namely, the features of the evaporator 140, adjustment unit and racks 110 are applicable to the cold storage room 200 as well.

Accordingly, the present invention has the following effects or advantages.

First of all, the adjustment unit adjusts the quantity of the cold air supplied to each of the chambers appropriately and easily, whereby the refrigerator can store specific food or objects at a specific temperature with maximal freshness.

Secondly, the adjustment unit has a relatively simple configuration, thereby lowering induction resistance and the load of the fan motor.

Finally, by application of the evaporator having a small height and by the removal of the cold air duct, the inner space of the freezer room can be considerably increased.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A refrigerator comprising:

a body having a cold storage room and a freezer room;

an evaporator provided to the body to generate cold air;

a plurality of racks partitioning each of the cold storage and freezer rooms into a plurality of chambers; and at least one adjustment device extended from each rear end portion of the plurality of racks, the at least one adjustment device configured to adjust a quantity of the cold air supplied to each of the plurality of chambers, wherein the at least one adjustment device is configured to adjust a gap between the rear end portion of the respective rack and a rear wall of the freezer or cold storage room.

2. The refrigerator of claim 1, wherein the cold storage room and the freezer room are arranged side by side.

3. The refrigerator of claim 1, wherein the evaporator is configured to blow the cold air upwardly along a rear wall of the cold storage or freezer room.

4. The refrigerator of claim 1, wherein the evaporator is arranged in the vicinity of the freezer room.

5. The refrigerator of claim 1, wherein the evaporator is provided in a lower rear part of the freezer room.

6. The refrigerator of claim 1, further comprising a cover enclosing the evaporator.

7. The refrigerator of claim 6, wherein the cover comprises an outlet configured to blow the cold air upwardly.

8. The refrigerator of claim 7, wherein the cover further comprises an auxiliary outlet configured to directly blow the cold air to the chamber in the vicinity of the evaporator.

9. The refrigerator of claim 1, wherein the plurality of racks are horizontally arranged.

10. The refrigerator of claim 1, wherein each of the plurality of the racks leaves a predetermined gap from a rear wall of the freezer or cold storage room.

11. The refrigerator of claim 1, further comprising a cold air passage provided between a rear wall of the freezer or cold storage room and the rear end portions of the plurality of racks to allow the cold air to flow therein to supply the cold air to the chambers.

12. The refrigerator of claim 1, wherein the at least one the adjustment unit device is attached to each rear end portion of the plurality of racks, respectively.

13. The refrigerator of claim 11, wherein the at least one adjustment device is configured to adjust a cross-sectional area of the cold air passage for flowing the cold air therein.

14. The refrigerator of claim 1, wherein gaps between the adjustment devices and the rear wall of the freezer or cold storage room are gradually narrowed along a flow direction of the cold air.

15. The refrigerator of claim 1, wherein the at least one adjustment device comprises a separator movably provided at the rear end portion of the respective rack.

16. The refrigerator of claim 15, wherein the separator comprises a plate member.

17. The refrigerator of claim 15, wherein the separator is rotatably attached to the rear end portion of the respective rack.

18. The refrigerator of claim 17, wherein the separator is configured to be turned upwardly and downwardly.

19. The refrigerator of claim 15, wherein the separator is provided at the rear portion of the rack so as to be movable backward and forward.

20. The refrigerator of claim 15, wherein the at least one adjustment device further comprises a drive mechanism configured to selectively drive the separator according to a cold air quantity required for the corresponding chamber.

21. The refrigerator of claim 20, the drive mechanism comprises:

a slider configured to slide forward and backward; and a link bar hingedly attaching the slider and the separator.

22. The refrigerator of claim 21, wherein the slider is projected from a front end portion of the rack to be operated by a user.

23. The refrigerator of claim 21, the drive mechanism further comprising a groove extending parallel to a lateral side of the rack configured to receive the slider therein.

24. The refrigerator of claim 15, wherein minimal gaps between the separators and a rear wall of the freezer or cold storage room are gradually decreased along a flow direction of the cold air.

25. The refrigerator of claim 15, wherein lengths of the separators gradually increase along a flow direction of the cold air.

26. The refrigerator of claim 1, further comprising a barrier provided to leave a predetermined interval from a rear wall of the freezer or cold storage room, wherein the barrier is configured to flow the cold air to a plurality of the chambers.

27. The refrigerator of claim 26, wherein the barrier is configured to conceal the adjustment units.

28. The refrigerator of claim 26, wherein the barrier upwardly extends from a rear end portion of each of the plurality of racks.

29. The refrigerator of claim 26, wherein the barrier is configured to cover and conceal the evaporator.

* * * * *